United States Patent [19]

Poe et al.

[11] 4,130,307

[45] Dec. 19, 1978

[54] PIN LATCH AND SAFETY LOCK THEREFOR

[75] Inventors: L. Richard Poe, Long Beach; Raymond E. Harmon, Orange, both of Calif.

[73] Assignee: Hartwell Corporation, Placentia, Calif.

[21] Appl. No.: 848,441

[22] Filed: Nov. 4, 1977

[51] Int. Cl.[2] ..... E05C 1/06

[52] U.S. Cl. ..... 292/179; 292/97

[58] Field of Search ..... 292/161, 167, 145, 153, 292/181, 139, 143, 97, 123, 156, 157, 158, 159, 179

[56] References Cited

U.S. PATENT DOCUMENTS

| | | | |
|---|---|---|---|
| 2,721,750 | 10/1955 | Rudis et al. | 292/139 |
| 2,815,975 | 12/1957 | Check et al. | 292/143 |
| 2,819,107 | 1/1958 | Muessel | 292/143 |
| 2,944,848 | 7/1960 | Mandolf | 292/181 |
| 4,025,096 | 5/1977 | Geer | 292/139 X |

*Primary Examiner*—J. Franklin Foss

*Attorney, Agent, or Firm*—Lyon & Lyon

[57] ABSTRACT

A safety lock for pin latches of the type including a manually engageable drive plate rotatable approximately 180° and connected through a linkage to a pin latch for reciprocal movement of the pin latch between a retracted disengaged position and an extended latched position, the safety lock being mounted on the linkage in such a manner as to prevent relative movement of the pin latch or linkage unless the safety lock is first manually engaged in a predetermined manner.

3 Claims, 7 Drawing Figures

PIN LATCH AND SAFETY LOCK THEREFOR

BACKGROUND AND SUMMARY OF THE INVENTION

An essentially flush type latch has had substantial use, the latch including a drive plate which is rotatable approximately 180° from a flush position and is connected through a linkage to a pin latch for reciprocal movement of the pin latch between an extended latched position and a retracted disengaged position. This latch has been used extensively on aircraft which use requires exacting dependability.

It appears that dependability is enhanced by a safety lock which is the subject of this invention and summarized in the following objects:

First, to provide a safety lock which may be mounted on the linkage provided in the above type of pin operating latch with minimum change in the latch.

Second, to provide a safety lock for pin latches of the type indicated which utilizes a manually arranged channel member having limited movement along the linkage between a position locking the drive plate against movement and a position freeing the drive plate for movement to release the latch pin.

Third, to provide a safety lock for pin latches of the type indicated wherein the safety lock may be manually engaged, and as the safety lock is released continued manual movement operates the drive plate; however, unless the initial manual movement is essentially parallel and contiguous to the flush surface of drive plate, the safety lock does not release the drive plate.

DETAILED DESCRIPTION

Figure 2:
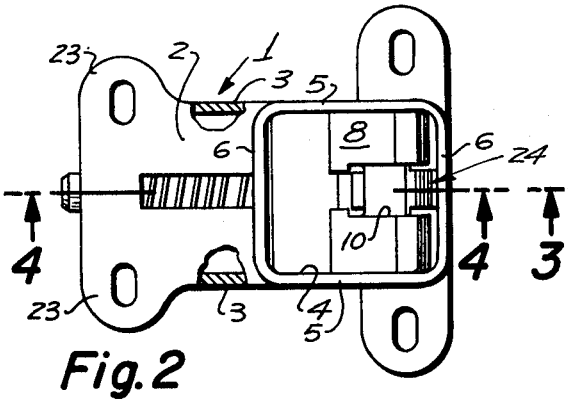
FIG. 2 is a similar plan view showing the pin latch in its retracted or disengaged position.
Figure 1:
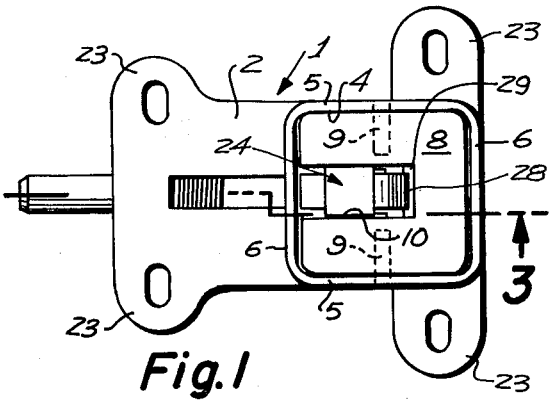
FIG. 1 is a plan view of the pin latch and a safety lock therefor, showing the latch in its secured position.

The pin latch adapted to utilize the safety lock includes a rectangular housing 1 having a web 2 occupying approximately one-half the length of the housing and side flanges 3 extending the full length of the housing. The portion of the housing not occupied by the web 2 is provided with an essentially square opening 4 occupying approximately one-half the length of the housing, the opening being bordered by raised side portions 5 continuing from the side flanges 3 and cross-flanges 6. Underlying the web 2 is a longitudinally extending pin guide 7.

The opening 4 receives a drive plate 8 of essentially square configuration secured to the raised portions 5 of the side flanges 3 by transversely aligned pivot pins 9. The drive plate is provided with a central slot 10 extending from the end of the drive plate contiguous to the web 2. The slot is bordered by a pair of bosses 8*a*.

Slideably mounted in pin guide 7 is a pin latch 11 having a spring retainer pin 12. A spring 13 is disposed between the pin 12 and the pin guide 7 to urge the pin latch towards a retracted position.

The axially inner end of the pin latch is connected to a link bar 14, having a clevis 15 straddling the end of the pin latch and receiving a journal pin 16. The link bar 14 extends under the drive plate 8 and is provided with an upwardly extending boss 17 which is received in the central slot 10, and is connected to the drive plate 8 by a journal pin 18. The link bar 14 includes a lip 19 which extends under the drive plate 8. The upper surfaces of the drive plate 8 and boss 17 are both essentially flush with the upper edges of the raised portions 5 and cross-flanges 6.

The height of the raised portions 5 and cross-flanges 6 with respect to the web 2 corresponds to the thickness of a door or panel member 20 indicated fragmentarily by broken lines. The door or panel member sits within a frame 21 in flush relation therewith. The frame 21 is provided with a keeper 22, also indicated by broken lines, which receives the pin latch 11. The housing 1 is provided with lateral bosses 23 for attachment to the door or panel member 20. The structure so far described is conventional except for a slight addition to the slot 10 as will be described.

The boss 17 of the link bar 14 receives a channel safety lock 24 which includes a web 25 overlying the boss 17 and side flanges 26 which extend between the boss 17 and the slot 10. The side flanges 26 are provided with slots 27, through which the journal pin 18 extends so that the safety lock is secured to the boss 17 but is capable of limited longitudinal movement.

The web 25 is provided adjacent to the closed end of the slot 10 with an extension 28, which is folded upwardly for a short distance, then is folded to slope downwardly into the slot 10. The extremity of the extension engages a step 29 formed at the inner end of the slot 10 to prevent relative angular movement of the drive plate 8 and link bar 14. One of the webs 25 is folded across the inner end of the boss 17 to form a spring retainer 30. Aligned therewith in the boss 17 is a socket 31. The socket 31 receives a spring 32 which urges the safety lock in a direction to cause the extension 28 to engage the step 29.

Figure 3:
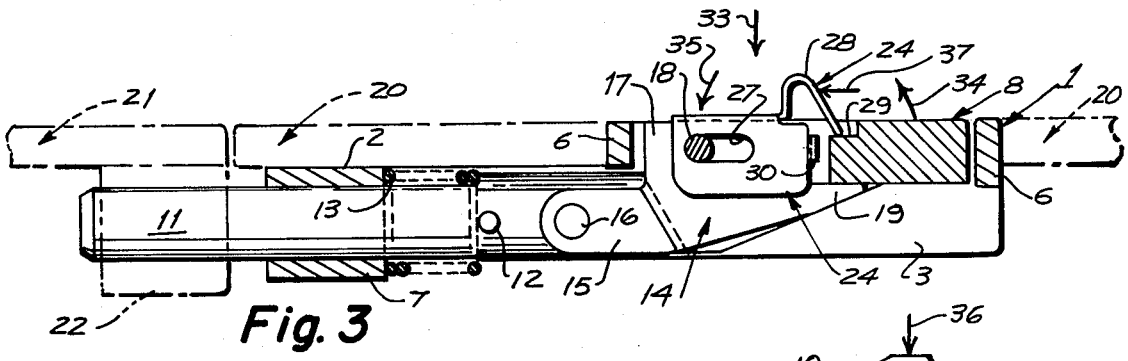
FIG. 3 is an enlarged longitudinal sectional view taken through 3—3 of FIG. 1, showing the pin latch in its extended position.
Figure 4:
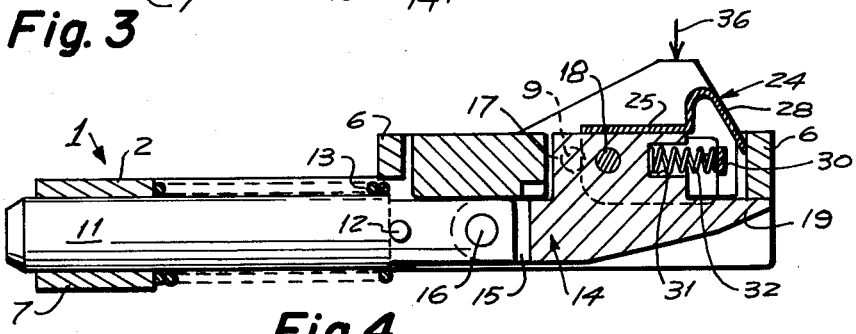
FIG. 4 is a similar enlarged longitudinal sectional view taken through 4—4 of FIG. 2, showing the pin latch in its retracted position.
Figure 6:
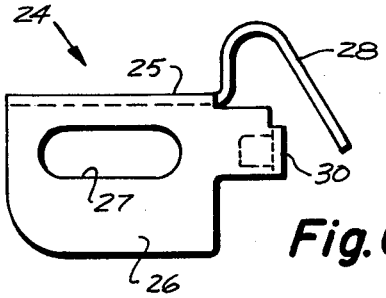
FIG. 6 is a further enlarged side view of the safety lock.
Figure 7:
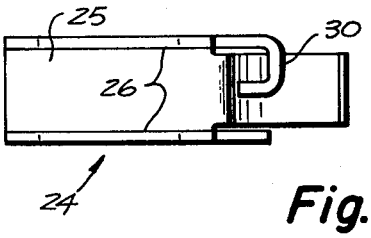
FIG. 7 is a bottom view thereof.
Figure 5:
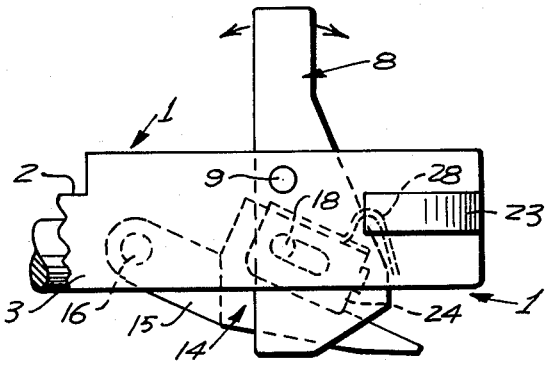
FIG. 5 is a fragmentary side view showing the movable parts of the pin latch in an intermediate position.

Operation of the pin latch and safety lock is as follows:

As indicated previously, if the pin lock is omitted, the remaining latch structure is conventional. In order to operate the conventional structure, the pin latch 11 is retracted by first pressing downward in the region of the arrow 33 indicated in FIG. 3. This causes the drive plate 8 to pivot upwardly as indicated by the arrow 34. This causes the connection between the drive plate 8 and link bar 14 to move in the direction of the arrow 35. The rotational movement of the pivotal axis of the drive plate 8 continues until the parts are in the position shown in FIG. 4 and the pin latch 11 is retracted. Reverse movement occurs when pressure is applied to the bosses 8*a* in the direction of the arrow 36. It will be noted that movement in either direction past center causes automatic movement of the parts, under urge of the spring 13, to either the position shown in FIG. 3 or the position shown in FIG. 4. In FIG. 3, movement is terminated by engagement of the lip 19 to the underside of the drive plate 8. Similarly, movement in the opposite direction is terminated by engagement of the lip 19 with the underside of the cross-flange 6 at the end of the housing.

The safety lock 24 prevents rotation of the drive plate 8 by reason of the fact that the extremity of the extension 28 engages the step 29, thus resisting movement in the direction of the arrow 33. However, if pressure is applied against the extension 28 in the direction of the arrow 37, the extension disengages the step 29 permitting normal rotation of the drive plate and corresponding retraction of the pin latch 11.

Having fully described our invention, it is to be understood that we are not to be limited to the details herein set forth, but that our invention is of the full scope of the appended claims.

We claim:

1. A safety lock for pin latches of the type including a housing, a drive plate mounted in the housing for partial rotation, and connected through a linkage to a pin latch slidably movable between an extended position and a retracted position relative to the housing, the drive plate having a slot to receive a portion of the linkage, and having a portion in essentially coplanar relation with the linkage portion, the linkage and drive plate having confronting portions capable of relative angular movement on manual engagement, said safety lock comprising:

a. a channel shaped reciprocal means mounted on the linkage portion and capable of sliding movement with respect to the drive plate;

b. a locking element carried by the reciprocal means for movement between an extended position engagable with the other confronting portion to lock the drive plate and linkage against relative movement and a retracted position permitting such movement;

c. a spring urging the locking element toward its extended locking position;

d. said locking element being manually engagable to release the drive plate and linkage for further manual engagement to effect retraction to the pin latch.

2. A latch structure, comprising:

a. a housing defining a flange bordered opening whereby the flange border may be mounted flush with a surrounding surface;

b. a drive plate mounted in the opening for partial rotation;

c. a pin latch reciprocally mounted in the housing;

d. a linkage pivotally connected to the pin latch and drive plate to effect reciprocation of the pin latch upon rotation of the drive plate;

e. the pivotal connection between the linkage and drive plate effecting retraction of the pin latch upon inward pressure applied to the linkage and drive plate in the vicinity of their pivotal connection.

f. and a member slideably carried by the linkage engageable with the drive plate to prevent relative pivoting of the linkage and drive plate, said slideable member being manually engageable in a direction parallel to the surface of the drive plate to permit subsequent pivotal movement.

3. A latch structure, as defined in claim 2, wherein:

a. said drive plate is provided with a slot receiving a portion of the linkage;

b. said slideable member is channel shaped and conforming to the slot received portion of the linkage; and c. a spring urges the slideable member into locking engagement with the drive plate.

* * * * *